US010410497B1

(12) United States Patent
Coq et al.

(10) Patent No.: US 10,410,497 B1
(45) Date of Patent: Sep. 10, 2019

(54) ANONYMOUS NOTIFICATION AND INTERVENTION OF USERS REQUIRING ASSISTANCE

(71) Applicant: International Business Machines Corporation, Armonk, NY (US)

(72) Inventors: Marc H. Coq, Hopewell Junction, NY (US); William J. Green, Cary, NC (US); Regina D. Jones, Lithia Springs, GA (US); Kelly Malone, Essex, MA (US); Joey A. Perry, Pflugerville, TX (US); Wendell P. Ramsey, Austin, TX (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/922,078

(22) Filed: Mar. 15, 2018

(51) Int. Cl.
*G08B 21/04* (2006.01)

(52) U.S. Cl.
CPC ..... *G08B 21/0423* (2013.01)

(58) Field of Classification Search
CPC ..... G08B 21/0423
USPC ..... 340/573.1
See application file for complete search history.

(56) References Cited

U.S. PATENT DOCUMENTS 6,882,837 B2 * 4/2005 Fernandez ..... G08B 25/016 455/404.1
7,058,385 B2 * 6/2006 Lauper ..... H04M 3/42 455/404.1
2005/0197775 A1 * 9/2005 Smith ..... G08B 21/10 702/3
2009/0176524 A1 7/2009 David
2012/0003955 A1 * 1/2012 Gabriel ..... G08B 25/001 455/404.2
2014/0273912 A1 9/2014 Peh et al.
2014/0298269 A1 * 10/2014 Underkoffler ..... G06F 3/017 715/848
2015/0332581 A1 11/2015 Gaurav et al.
2016/0099895 A1 4/2016 Crawford
2018/0025373 A1 * 1/2018 Perriman ..... G06Q 30/0205
2018/0032997 A1 * 2/2018 Gordon ..... G06Q 20/3224
2018/0053401 A1 * 2/2018 Martin ..... H04L 67/04

OTHER PUBLICATIONS ip.com "Discreet Emergency Notification with Location Tracking" IP.com No. IPCOM000012848D, Publication Date Jun. 3, 2003, 6 pages.

* cited by examiner

*Primary Examiner* — Jack K Wang
(74) *Attorney, Agent, or Firm* — Cantor Colburn LLP; Tihon Poltavets

(57) ABSTRACT

Embodiments of the invention include techniques for anonymous notification and intervention users requiring assistance, where the techniques include receiving an input from a user at a location, wherein the input is associated with an event requiring assistance from another user, and dynamically assigning a neighborhood based at least in part on the input, wherein the neighborhood represents a vicinity of the location. The techniques also include determining at least a threshold number of users is in the neighborhood, and based on the determination, sending a real-time alert to the users in the neighborhood, wherein the real-time alert includes information pertaining to the event requiring assistance.

20 Claims, 10 Drawing Sheets

500

600

ANONYMOUS NOTIFICATION AND INTERVENTION OF USERS REQUIRING ASSISTANCE

BACKGROUND

The present invention generally relates to digital communications, and more specifically, to a system and method for anonymous notification and intervention of users requiring assistance.

For various reasons, individuals may find themselves in situations needing assistance. Various alert and notification systems are used to broadcast information to the public. These systems include amber alerts, social media applications, and other techniques. After receiving an alert, the user can determine how to respond to the alert such as notifying the proper authorities or taking some other action. Alarm systems and home monitoring systems are commonly used to provide protection over a specified area. Alerts related to these systems are generally provided to a static list of contacts and/or a monitoring service that is capable of contacting emergency responders/authorities

SUMMARY

Embodiments of the present invention are directed to a computer-implemented method for anonymous notification and intervention of users requiring assistance. A non-limiting example of the computer-implemented method includes receiving an input from a user at a location, wherein the input is associated with an event requiring assistance from another user, and dynamically assigning a neighborhood based at least in part on the input, wherein the neighborhood represents a vicinity of the location. The method also includes determining at least a threshold number of users is in the neighborhood, and based on the determination, sending a real-time alert to members of the neighborhood, wherein the real-time alert includes information pertaining to the event requiring assistance.

Embodiments of the present invention are directed to a system for anonymous notification and intervention of users requiring assistance. A non-limiting example of the system includes a storage medium, the storage medium being coupled to a processor, where the processor is configured to receive an input from a user at a location, wherein the input is associated with an event requiring assistance from another user, and dynamically assign a neighborhood based at least in part on the input, wherein the neighborhood represents a vicinity of the location. The processor is further configured to determine at least a threshold number of users is in the neighborhood, and based on the determination, send a real-time alert to the users in the neighborhood, wherein the real-time alert includes information pertaining to the event requiring assistance.

Embodiments of the invention are directed to a computer program product for anonymous notification and intervention of users requiring assistance, the computer program product including a computer readable storage medium having program instructions embodied therewith. The program instructions are executable by a processor to cause the processor to perform a method. A non-limiting example of the method includes receiving an input from a user at a location, wherein the input is associated with an event requiring assistance from another user, and dynamically assigning a neighborhood based at least in part on the input, wherein the neighborhood represents a vicinity of the location. The method also includes determining at least a threshold number of users is in the neighborhood, and based on the determination, sending a real-time alert to members of the neighborhood, wherein the real-time alert includes information pertaining to the event requiring assistance.

Additional technical features and benefits are realized through the techniques of the present invention. Embodiments and aspects of the invention are described in detail herein and are considered a part of the claimed subject matter. For a better understanding, refer to the detailed description and to the drawings.

BRIEF DESCRIPTION OF THE DRAWINGS

The specifics of the exclusive rights described herein are particularly pointed out and distinctly claimed in the claims at the conclusion of the specification. The foregoing and other features and advantages of the embodiments of the invention are apparent from the following detailed description taken in conjunction with the accompanying drawings in which:

Figure 1:
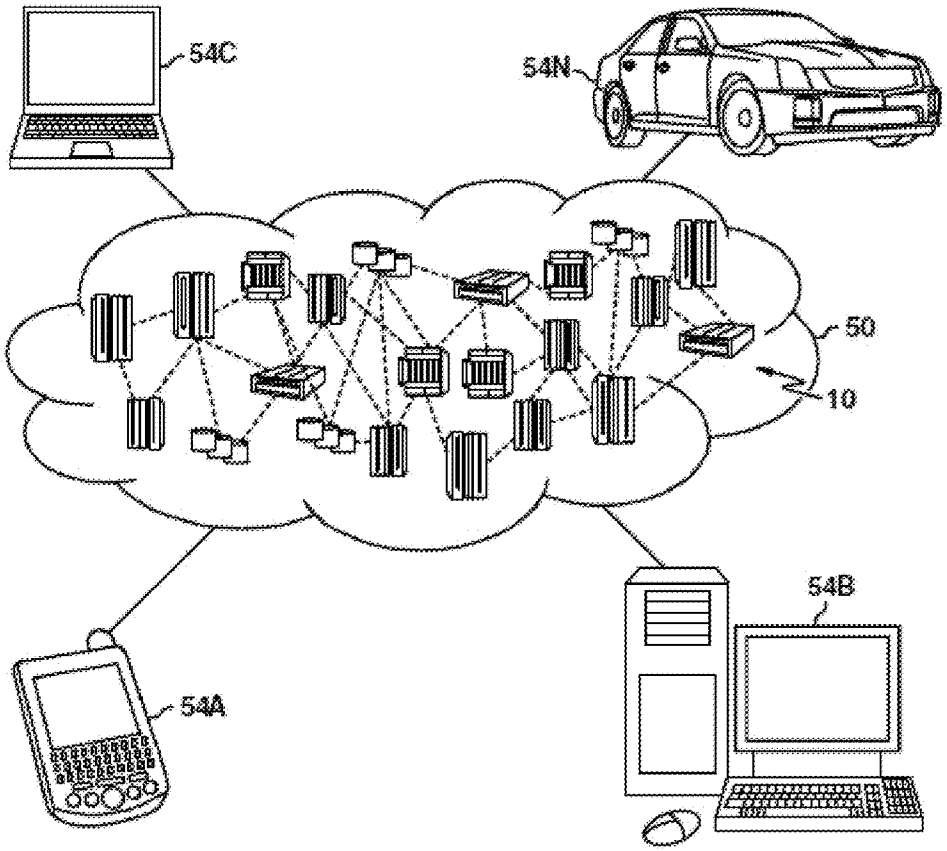
FIG. 1 depicts a cloud computing environment according to one or more embodiments of the present invention.

The diagrams depicted herein are illustrative. There can be many variations to the diagrams or the operations described therein without departing from the spirit of the invention. For instance, the actions can be performed in a differing order or actions can be added, deleted or modified. Also, the term "coupled" and variations thereof describes having a communications path between two elements and does not imply a direct connection between the elements with no intervening elements/connections between them. All of these variations are considered a part of the specification.

In the accompanying figures and following detailed description of the disclosed embodiments, the various elements illustrated in the figures are provided with two or three digit reference numbers. With minor exceptions, the leftmost digit(s) of each reference number correspond to the figure in which its element is first illustrated.

DETAILED DESCRIPTION

In accordance with embodiments of the disclosure, methods, systems and computer program products for implementing anonymous notification and intervention are provided. One or more embodiments of the invention provide for the notification of conditions of a distressed user requiring assistance to a social group of anonymous users who are using the same application.

Users are given the ability to log-in to an application and system to update their status based on a perceived need. In other aspects of the invention, the system can periodically prompt the user for a response to determine if the user needs assistance. Based on the user's response, the system can automatically send out an alert to a set or sub-set of members of the social network without regard to whether the user knows the other members to try and locate assistance. In addition, the system can define the set of members based on one or more factors. This technique increases the number of responders and response times to provide aid to the user requiring assistance.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Referring now to FIG. 1, illustrative cloud computing environment 50 is depicted. As shown, cloud computing environment 50 comprises one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 1 are intended to be illustrative only and that computing nodes 10 and cloud computing environment 50 can communicate with any type of computerized device over any type of network and/or network addressable connection (e.g., using a web browser).

Figure 2:
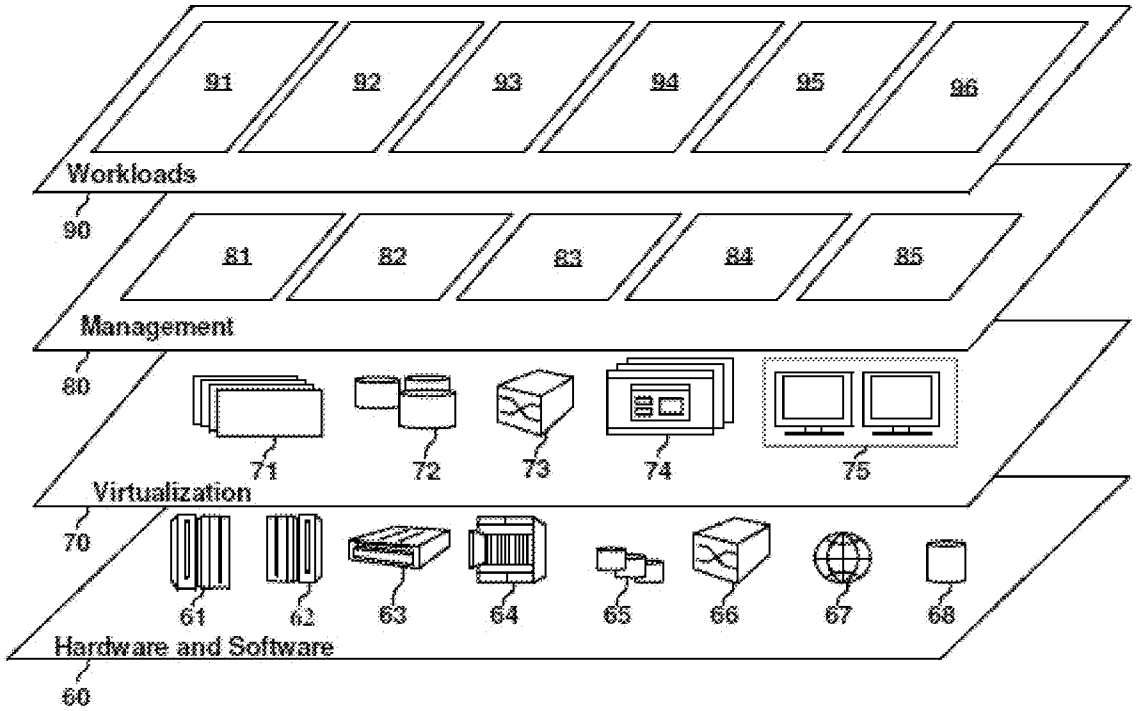
FIG. 2 depicts abstraction model layers according to one or more embodiments of the present invention.

Referring now to FIG. 2, a set of functional abstraction layers provided by cloud computing environment 50 (FIG. 1) is shown. It should be understood in advance that the components, layers, and functions shown in FIG. 2 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may comprise application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provides pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and action analytics and notifications 96.

Figure 3:
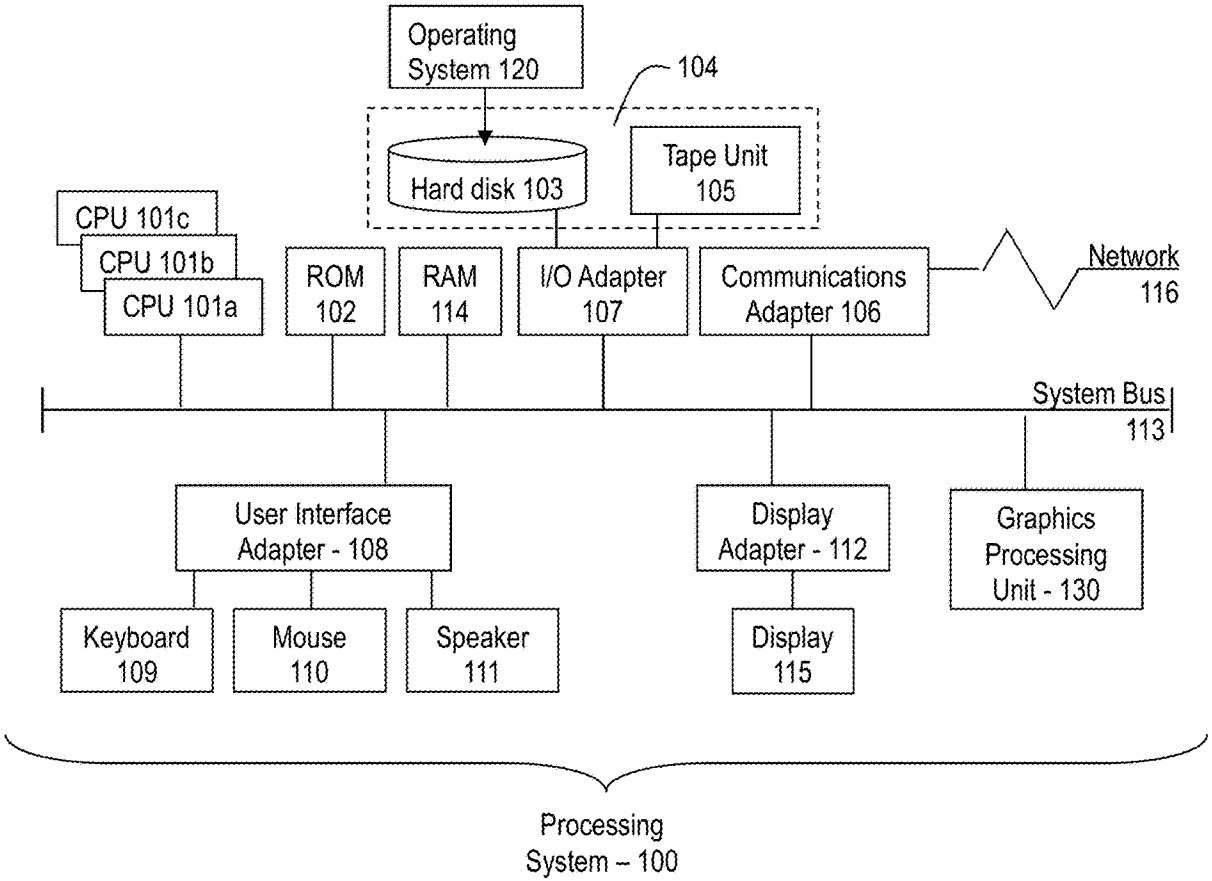
FIG. 3 illustrates a block diagram of a computer system for use in practicing the teachings herein.

Referring to FIG. 3, there is shown an embodiment of a processing system 100 for implementing the teachings herein. In this embodiment, the system 100 has one or more central processing units (processors) 101*a*, 101*b*, 101*c*, etc. (collectively or generically referred to as processor(s) 101). In one or more embodiments, each processor 101 may include a reduced instruction set computer (RISC) microprocessor. Processors 101 are coupled to system memory 114 and various other components via a system bus 113. Read only memory (ROM) 102 is coupled to the system bus 113 and may include a basic input/output system (BIOS), which controls certain basic functions of system 100.

FIG. 3 further depicts an input/output (I/O) adapter 107 and a network adapter 106 coupled to the system bus 113. I/O adapter 107 may be a small computer system interface (SCSI) adapter that communicates with a hard disk 103 and/or tape storage drive 105 or any other similar component. I/O adapter 107, hard disk 103, and tape storage device 105 are collectively referred to herein as mass storage 104. Operating system 120 for execution on the processing system 100 may be stored in mass storage 104. A network adapter 106 interconnects bus 113 with an outside network 116 enabling data processing system 100 to communicate with other such systems. A screen (e.g., a display monitor) 115 is connected to system bus 113 by display adaptor 112, which may include a graphics adapter to improve the performance of graphics intensive applications and a video controller. In one embodiment, adapters 107, 106, and 112 may be connected to one or more I/O busses that are connected to system bus 113 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 113 via user interface adapter 108 and display adapter 112. A keyboard 109, mouse 110, and speaker 111 all interconnected to bus 113 via user interface adapter 108, which may include, for example, a Super I/O chip integrating multiple device adapters into a single integrated circuit.

In exemplary embodiments, the processing system 100 includes a graphics processing unit 130. Graphics processing unit 130 is a specialized electronic circuit designed to manipulate and alter memory to accelerate the creation of images in a frame buffer intended for output to a display. In general, graphics processing unit 130 is very efficient at manipulating computer graphics and image processing and has a highly parallel structure that makes it more effective than general-purpose CPUs for algorithms where processing of large blocks of data is done in parallel.

Thus, as configured in FIG. 3, the system 100 includes processing capability in the form of processors 101, storage capability including system memory 114 and mass storage 104, input means such as keyboard 109 and mouse 110, and output capability including speaker 111 and display 115. In one embodiment, a portion of system memory 114 and mass storage 104 collectively store an operating system coordinate the functions of the various components shown in FIG. 3.

Various embodiments of the invention are described herein with reference to the related drawings. Alternative embodiments of the invention can be devised without departing from the scope of this invention. Various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. Moreover, the various tasks and process steps described herein can be incorporated into a more comprehensive procedure or process having additional steps or functionality not described in detail herein.

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" may be understood to include any integer number greater than or equal to one, i.e. one, two, three, four, etc. The terms "a plurality" may be understood to include any integer number greater than or equal to two, i.e. two, three, four, five, etc. The term "connection" may include both an indirect "connection" and a direct "connection."

The terms "about," "substantially," "approximately," and variations thereof, are intended to include the degree of error associated with measurement of the particular quantity based upon the equipment available at the time of filing the application. For example, "about" can include a range of ±8% or 5%, or 2% of a given value.

For the sake of brevity, conventional techniques related to making and using aspects of the invention may or may not be described in detail herein. In particular, various aspects of computing systems and specific computer programs to implement the various technical features described herein are well known. Accordingly, in the interest of brevity, many conventional implementation details are only mentioned briefly herein or are omitted entirely without providing the well-known system and/or process details.

Turning now to an overview of technologies that are more specifically relevant to aspects of the invention, conventional systems push notifications of a subject to a specified response center and not directly to an anonymous group of members as described herein. One or more aspects of the invention leverage anonymous users that are part of the same social network to provide the notifications. Oftentimes individuals find themselves in need of assistance with little to no assistance from others.

Conventional notification systems use a static or predetermined list of contacts to provide alerts when an triggering event is detected. For example, contact lists generally include emergency contacts and information for close family and friends. These notifications can also be broadcasted through emails and other electronic means. Although the static lists can be updated manually by a user, they are not updated dynamically in real-time based on the current condition and location of the user requiring assistance. In this particular scenario, a broadcast can be sent to a large number of people without any regard to their proximity and ability to provide assistance to the user requiring assistance. In addition, the individuals that are alerted are usually people who are known or have some relationship to the user requiring assistance.

The techniques described herein provide alerts that are not blindly broadcasted to a large number of people but instead each user that receives the alert has been determined to be in a position to provide assistance to the user based at least in part on a proximity to the user or response time to the user.

Turning now to an overview of the aspects of the invention, one or more embodiments of the invention address the above-described shortcomings of the prior art by providing a technique to alert a dynamic group of anonymous users of a situation in real-time. The dynamic group of anonymous users is determined based on one or more factors. For example, the dynamic group can be based at least in part on the user density, classification, topography, etc. In addition, the dynamic group is selected based on proximity to the user requiring assistance so that people who are deemed outside of the range to provide assistance are not alerted. In addition, the dynamic group can also be updated when the initially defined group does not include a sufficient number of other members to provide assistance to the user.

A technique is provided to alert members of another member's status that are part of the social network. As a user requiring assistance updates their current status, other members, who may be known and unknown to the user, are able to see the status and location of the user to provide assistance. The system and method described herein provide dynamic notifications to other members who may be logged into the social network, where the members receive the notification based on the location and proximity to the user requiring assistance. One or more embodiments of the invention provide a technique to determine whether a threshold number of members are within proximity of the user requiring assistance in order to provide assistance. In the event a sufficient number of members are not within proximity, the search area for other users is dynamically expanded.

The above-described aspects of the invention address the shortcomings of the prior art by providing systems and methods for defining a set of members of a social network and alerting those members of a social network of a status of a user requiring assistance. Various techniques can be implemented to determine which members are notified. Members who are not deemed to be in a position to provide assistance to the user requiring assistance are not notified.

Figure 4:
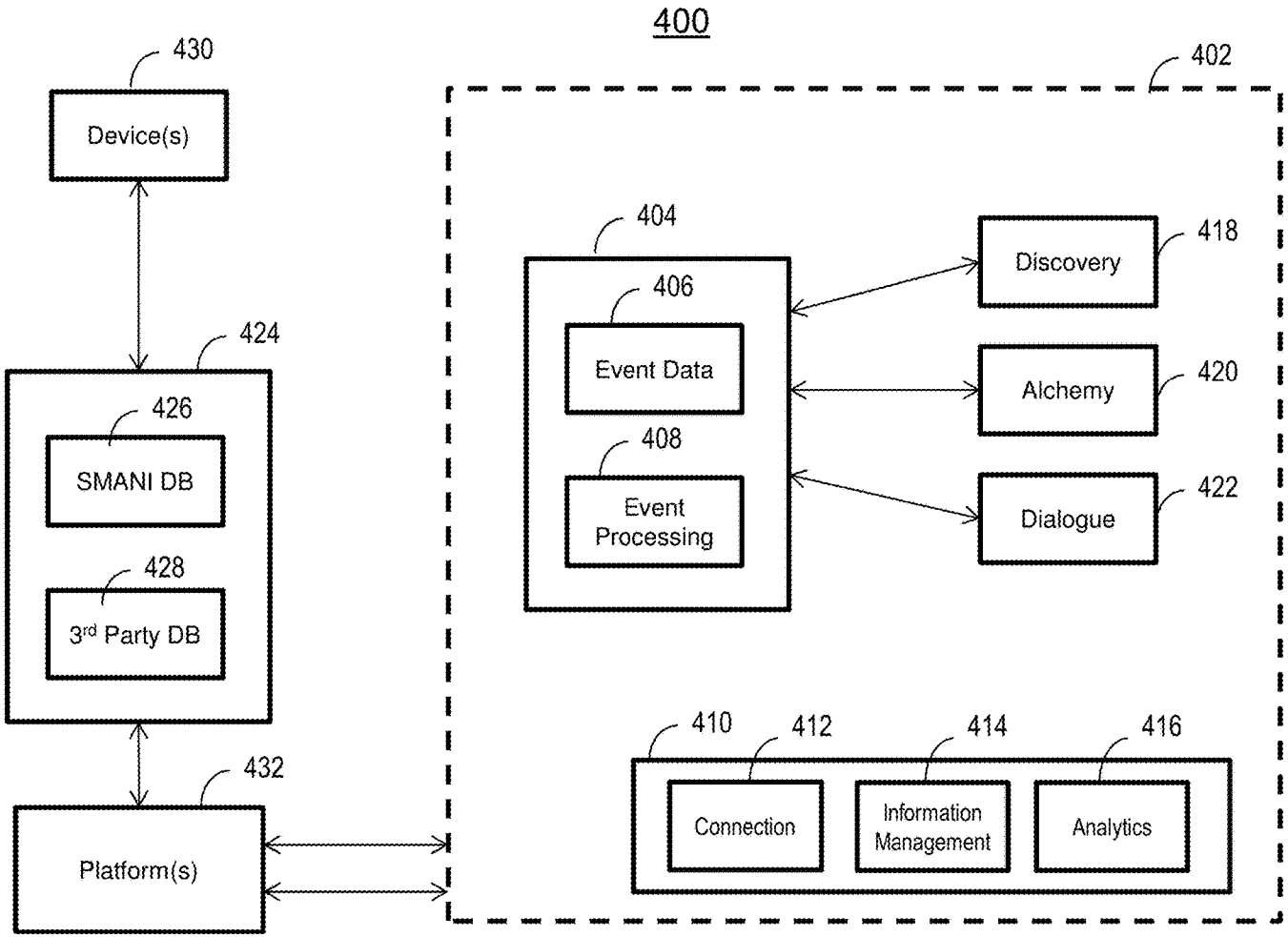
FIG. 4 depicts a system for anonymous notification and intervention of users requiring assistance in accordance with one or more embodiments.

Turning now to a more detailed description of aspects of the present invention, FIG. 4 depicts a system 400 in accordance with one or more embodiments of the invention. Embodiments of the invention can implement the system and method for anonymous notification and intervention (SMANI) 402 in the cloud environment as shown in FIG. 1 and FIG. 2 or the system 100 of FIG. 3. The SMANI 402 can implement a plurality of functions and modules. It is to be understood that other configurations, modules, processors, software and/or hardware is within the scope of the invention.

In one or more embodiments of the invention, SMANI 402 includes an event manager 404. In addition, the event manager 404 includes event data module 406 and an event processing module 408. The event data component 406 can be configured to receive, process, and store data such as but not limited to user input, data from a database, application feeds, etc. In addition, the event processing component 408 can include route validation and crisis detection. The event manager 404 can also be coupled to various platforms such as the Watson IoTs Platform 410. This platform 410 can include one or more modules to execute various functions. For example, the platform 410 manages connections 412, information management 414, analytics 416, etc. It is to be understood that other functions, modules, and/or processors can be included within the platform 410.

In a non-limiting example, the system 400 is configured to perform various functions such as but not limited to discovery 418, alchemy 420, and dialogue 422 functions. Discovery functions 418 include data exploration and extraction. Alchemy functions 420 can include performing targeted searches of the surrounding area for crisis events and route impediments. The dialogue functions 422 can include automating branching conversations between the user and SMANI.

In one or more embodiments of the invention, a database 424 is configured to exchange data with other devices 430, databases, and/or platforms. The SMANI database 426 can receive data from devices 430 such as mobile devices and wearable technology, GPS, mapping systems, etc. The SMANI database 426 can authenticate data that is received from the devices 430 and/or other databases 428. In different embodiments, other databases 428 can include mapping databases, news feeds, etc., can exchange data in accordance with techniques provided herein.

The database 424 is also configured to communicate with hub 432 such as an IBM's IoT Hub which manages connected devices to access live and historical data.

In one or more embodiments of the invention, GPS data from personal devices and wearable technology can provide the information to the system to determine the location of users. Location data can be obtained by other known techniques such as triangulating communication signals or determining the location of the wireless access points/base stations. In one or more embodiments of the invention, the system is coupled to one or more $3^{rd}$ party databases such as GPS and mapping applications, news feeds, police, fire, or other emergency responder databases.

In one or more embodiments of the invention, the system dynamically determines which users to notify. In contrast to conventional systems, the described invention is not limited to utilizing static lists. Users that are logged-in to the system within a proximity to the user can be alerted prior to alerting emergency responders.

In one or more embodiments of the invention, the neighborhood can be dynamically updated based on one or more factors. The user can configure a threshold number of members to be included in the neighborhood. In addition, the user can configure an initial radius or distance for the determining the neighborhood.

In one or more embodiments of the invention, the system can determine a path deviation of a user to predict whether the user is in need of assistance.

In one or more embodiments of the invention, a deviation can be determined based on an expected time of arrival. For example, an expected time of arrival can be obtained from a mapping application for a selected route. The expected time of arrival can include current and/or historical traffic conditions. In addition, the time of arrival can be impacted by current weather conditions, accidents, detours, etc.

In the event the user has not reached their destination, the system can prompt a user of their current status. If a user fails to log-in a response, the system can automatically provide notifications to those logged-in members in a neighborhood.

Figure 5:
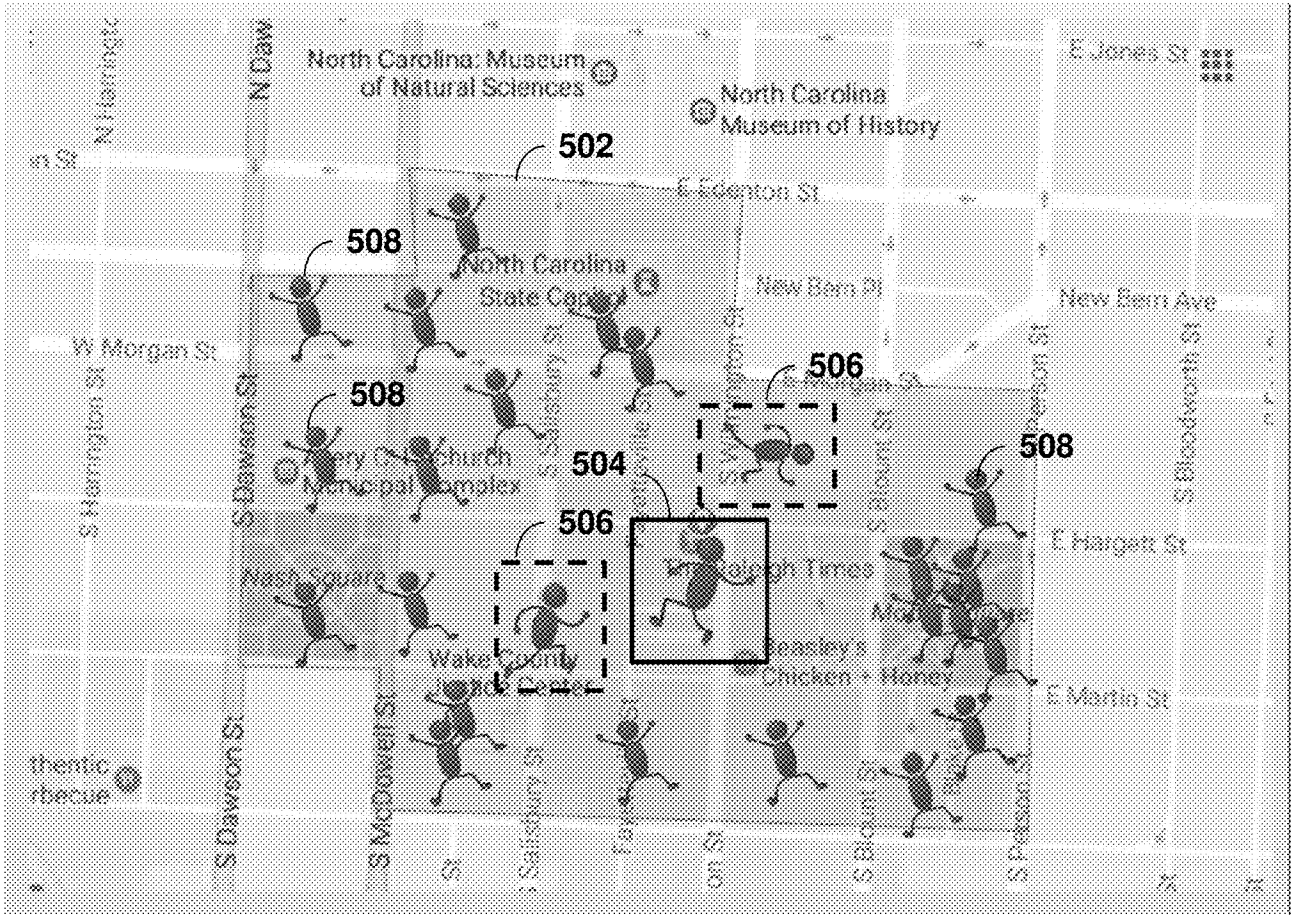
FIG. 5 depicts a map in accordance with one or more embodiments of the invention.

Now referring to FIG. 5, a mapping 500 in accordance with one or more embodiments is shown. In one or more embodiments of the invention, the system, such as the system 400 of FIG. 4, dynamically determines a set of members to notify based on several factors as noted above. These factors include but are not limited to topography, classification, population density, and user density. In addition, other factors can be considered to dynamically determine and update a neighborhood for notification.

The topography can describe the landscape associated with a geographic area. The topography can be determined based on information received from a mapping application. As non-limiting examples, the topography can describe the land associated with an area as the plains, mountainous, coastal, etc.

The classification of an area can be one of city, rural area, suburban area, etc. This information can also be obtained from a mapping application. This classification information can be used to determine how expansive the initial search for a neighborhood should be. For example, it is likely that in an urban city area a smaller neighborhood can include many members of the social network, while the same area in a rural area is not likely to yield as many members. This information can be used to configure the default search radius/distance based on the classification.

The user density describes the number of users that are logged-in to the system. The user density can be based on a specified area such as a city block, square miles, etc. The user density can be selected by the system or can be configured by the user of the application. It is likely that an area having a high population density will be correlated to the user density of the area.

FIG. 5 provides an example neighborhood 502 that has been determined by the system such as the system 400 of FIG. 4. In one or more embodiments of the invention, a map 500 can be transmitted and displayed to a user device. In this non-limiting example, the map 500 provides a neighborhood 502 defined in the border. As provided in the legend, the location and status of members within the social network are displayed. The legend includes active users, users requiring assistance, and responding users. It is to be understood that other statuses can be used to indicate the status of users such as but not limited to official emergency responders. In addition, other statuses may be used.

As shown in FIG. 5, the system has determined the neighborhood 502 as shown in the bordered area is located in an urban area that has a high user density. This information can be obtained from various mapping applications, news feeds, and other various sources. The user requiring assistance 504 is indicated on the map 500 after having updated their status to "needs assistance." The active users 508 are logged-in to the system/application and have been determined to be within the neighborhood 502. The responding users 506 are shown as having responded to the status alert from user requiring assistance 504. The other active users 508 continue to receive the status of the responding users 506 and the user requiring assistance 504.

The techniques described herein prevent the unnecessary transmission of notifications to people who are not in a position to help the user requiring assistance by determining and utilizing the neighborhood of anonymous users.

Figure 6:
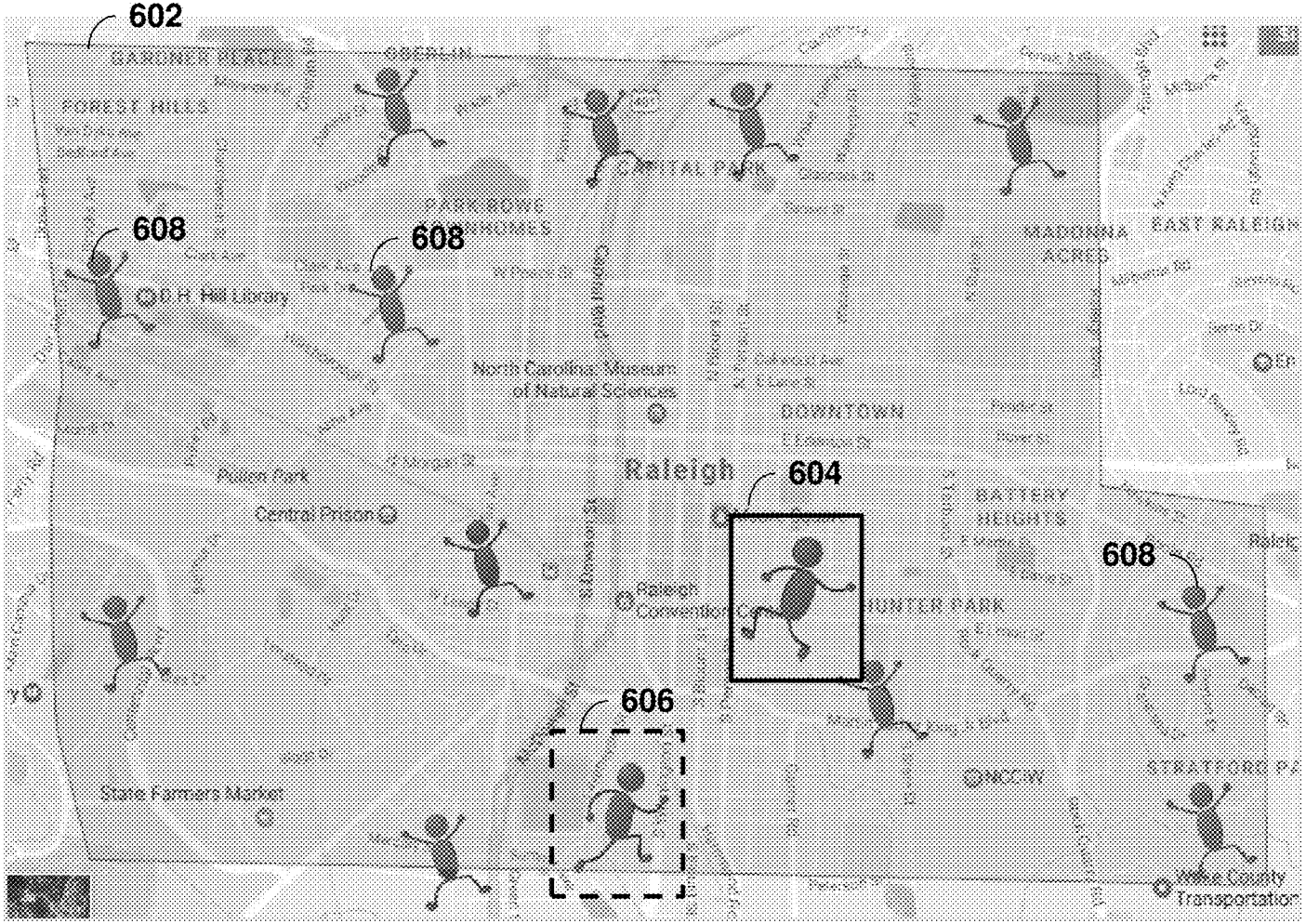
FIG. 6 depicts another map in accordance with one or more embodiments of the invention.

Now referring to FIG. 6, a map 600 is shown in accordance with one or more embodiments of the invention. In this non-limiting example, a neighborhood 602 has been determined by the system 400 of FIG. 4 for a rural classification having a less dense population when compared to the map 500. As shown in FIG. 6, the neighborhood 602 covers a large area however the area has a limited number of members. As shown in FIG. 6, the user 604 is shown as the user requiring assistance and the user 606 is shown as the responding user. Other active users 608 that are logged-in to the system are shown on the map 600.

In one or more embodiments of the invention, the initially determined neighborhood can be expanded to include more users. The area defined for the neighborhood can be symmetrical or asymmetrical. The area can be defined by a radius.

In one or more embodiments, the initial neighborhood can be based on and expanded by a configurable distance and/or a response time between the user requiring assistance and the other active members.

Figure 7:
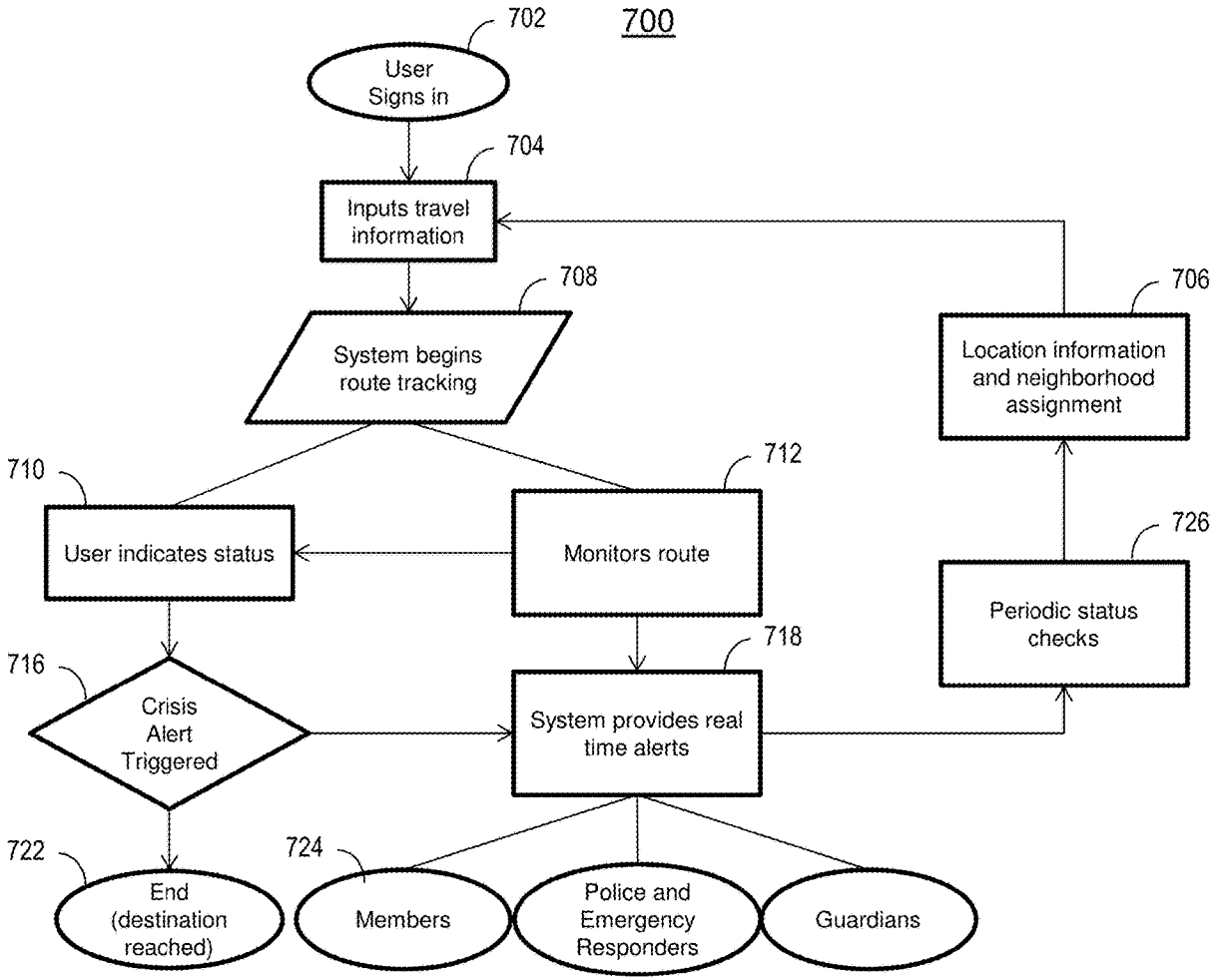
FIG. 7 depicts a flow chart for implementing a system and method of anonymous notification and intervention for users requiring assistance in accordance with one or more embodiment of the invention.

FIG. 7 depicts a flow chart 700 for implementing a system and method for anonymous notification and intervention. The method begins at block 702, which provides the user and/or members sign-in to the SMANI application. At block 704, the system receives the travel information. In one or more embodiments of the invention, the system also receives location information and neighborhood assignment information as shown in block 706. The location information includes the current location of the user and other members that are logged-in to the application. In addition, the system receives updates reflecting the new or updated location of the user and/or route of the user.

At block 708 the system begins tracking the route being traveled by the user. In one or more embodiments of the invention, the user can enter a selected route, mode of travel, expected arrival time, etc. As the user is in route to their destination, the system can monitor route traveled by the user as shown in block 712. The monitoring can include determining a deviation from a selected route, travel detours, traffic conditions, historical and current travel information, expected arrival time, etc.

While in route, the user can update their status by inputting the corresponding information into the application as shown in block 710. At decision block 716, the user status is checked for a triggering event having been triggered. In the event that no triggering event is triggered, the trip is ended at block 722 indicating that a user has made it to their destination.

In the event the user status indicates that a triggering event has been triggered at decision block 716, the system provides real-time alerts at block 718 to the appropriate users. In one or more embodiments, the real-time alerts are transmitted to the neighborhood of members 724 that are logged-in to the application. The real-time alerts can also be transmitted to police, fire, medical and other emergency responders. In other embodiments, the real-time alerts can be transmitted to guardians of the user requiring assistance. In one or more embodiments, the guardians can be determined based on a configurable static list by the user to ensure that alerts are received regardless of proximity. These real-time alerts can be transmitted periodically until a threshold number of members respond. In addition, the alerts can be transmitted to the members, emergency responders, and guardians simultaneously or in a sequence determined by the user or system. For example, in a scenario where a user requiring assistance is in a rural area with no members within the initially defined neighborhood, the system can automatically alert emergency responders so the user can get assistance as soon as possible. In another example, the user can configure their alerts to be transmitted simultaneously to the neighborhood, emergency responders, and their guardians. The alerts that are transmitted can provide various information about the user including location information of the users, the time the user updated their status, etc. In one or more embodiments of the invention, the real-time alerts include transmitting a list including a static portion of the list and the list includes a dynamic portion of the list, where the dynamic portion of the list is the assigned neighborhood and the static portion is a list configured by the user.

At block 726, the system performs periodic status checks of the user. This can include determining if a user has updated their status. After performing the status check at block 726 the system can update the location information neighborhood assignment at block 706 and continues with the method 700 of FIG. 7.

Figure 8:
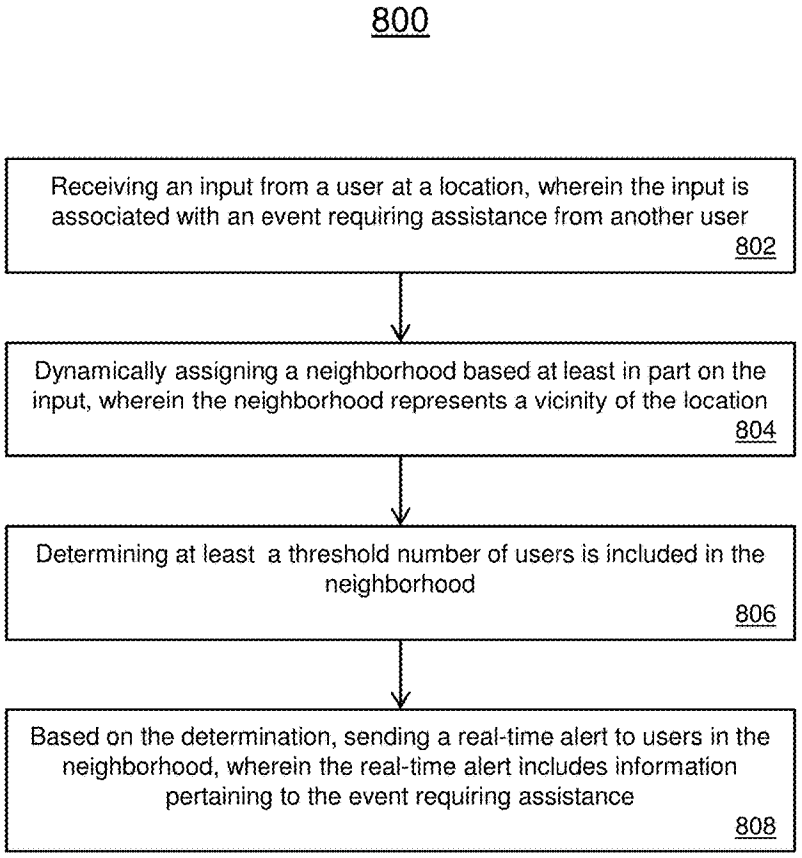
FIG. 8 depicts a flow chart for implementing a system and method for anonymous notification and intervention of users requiring assistance in accordance with one or more embodiments of the invention.

Now referring to FIG. 8, a flow chart 800 for anonymous notification and intervention is shown. Block 802 provides receiving an input from a user at a location, wherein the input is associated with an event requiring assistance from another user. In one or more embodiments of the invention, the user input can include current location, point of destination, travel path, transportation provider, etc. In addition, the user is able to enter their status information. In one or more embodiments of the invention, the status information can include a safe status, health status, and danger status. It is to be understood that other statuses are thought to be within the scope of one or more embodiments of the invention. In addition, GPS can be used to collect the user location. The GPS can be associated with a user device such as mobile phone or wearable technology or other device.

Block 804 provides dynamically assigning a neighborhood based at least in part on the input, wherein the neighborhood represents a vicinity of the location. The neighborhood is a group of users who are logged-in to the system who are within range of a user who signaled their status as in distress.

Block 806 provides determining at least a threshold number of users is included in the neighborhood. The threshold can be a configurable threshold that is selected by the user. In another embodiment, the threshold can be a default threshold. The number of users included in the neighborhood is compared to the threshold and in the event there are not enough users logged-in, the neighborhood will be expanded to increase the chances that more users who are logged in are included that can provide assistance to the user in distress.

Block 808 provides based on the determination, sending a real-time alert to the users in the neighborhood, wherein the real-time alert includes information pertaining to the event requiring assistance. In one or more embodiments of the invention, alerts are limited to those users within the neighborhood. This feature only alerts individuals that are in a position to offer assistance. The real-time alerts can include information such as the location of the user requiring assistance, distance and time to reach the user, anonymous user information, and the like. It is to be understood that other types of information can be provided in the alert.

In one or more embodiments of the invention, if another user is not detected within a configurable proximity to the user, the system can be configured to automatically call an emergency authority and provide the coordinates of the user requiring assistance. This feature ensures that user can get some assistance in a timely manner.

Figure 9:
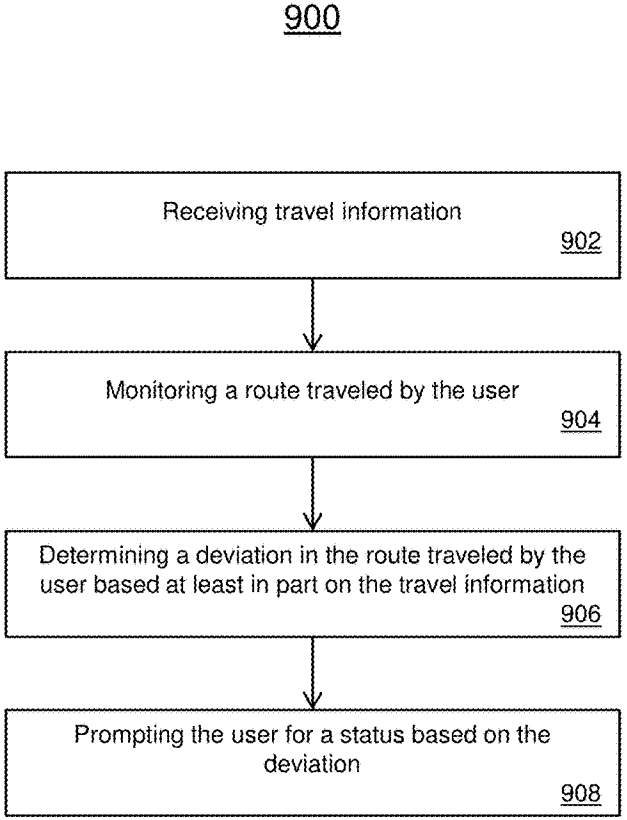
FIG. 9 depicts a flow chart for implementing a system and method for anonymous notification and intervention of users requiring assistance in accordance with one or more embodiments of the invention.

Now referring to FIG. 9, a flow chart 900 for anonymous notification and intervention in accordance with one or more embodiments is shown. Block 902 provides receiving travel information. In one or more embodiments of the invention, the travel information can include a mode of transportation taken by the user, a route selected by the user, traffic information, etc. In a non-limiting example, the mode or method of transportation can be by an automobile. In another non-limiting example, the user can indicate they are walking or riding a bicycle. In one or more embodiments of the invention, the user can indicate a particular taxi or ride share service that is being used. The user may select a preferred route for travel.

The system can consider current traffic conditions, historical traffic conditions based on the time of day, traffic detours, etc. to determine arrival times to the destination. In addition, this information can be used to increase or decrease the expected arrival time based on the current traffic conditions.

Block 904 provides monitoring a route traveled by the user. The system can receive GPS updates from a device of the user. The GPS information can be compared to the selected route of the user to determine whether a user has deviated from an expected path.

Block 906 provides determining a deviation in the route traveled by the user based at least in part on the travel information. In different embodiments of the invention, the deviation can be a configurable deviation. The deviation can be associated with distance and/or time from a selected or known path that has been entered into the system.

Block 908 provides prompting the user for a status based on the deviation in the route traveled by the user. In the event a user's traveled route has deviated from the expected path and/or the user has not arrived by an expected time of arrival, the system can be configured to prompt the user for a status.

If the user indicates that they are in need of assistance or a status update is not received from the user within a configurable period of time, the system can provide an alert to the members in the neighborhood of the user requiring assistance.

Figure 10:
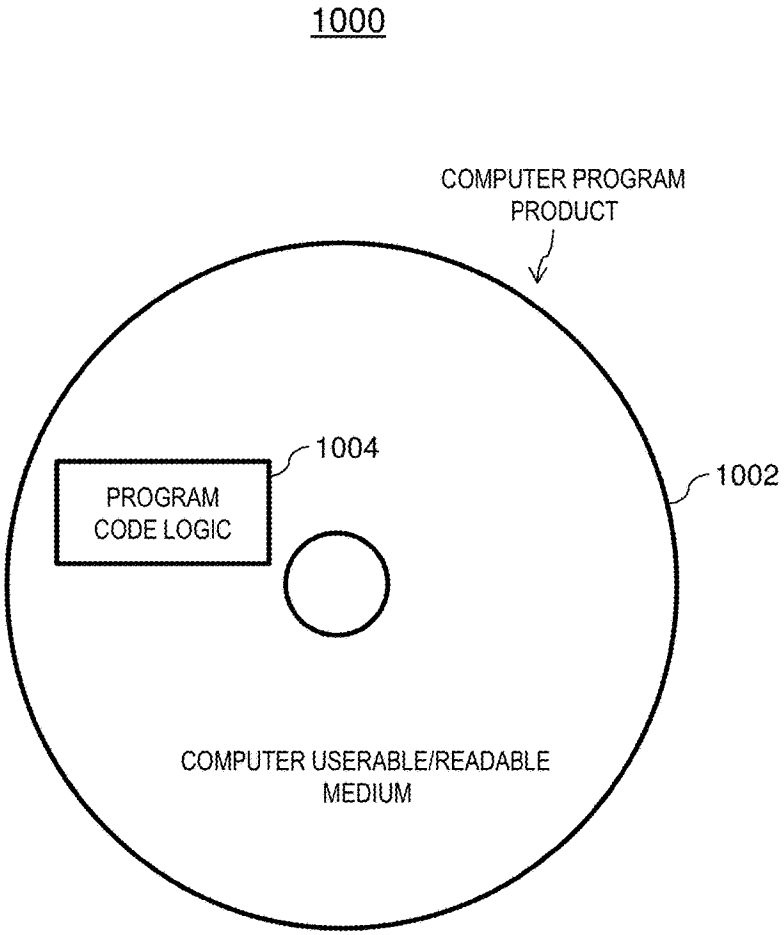
FIG. 10 depicts a computer-readable storage medium in accordance with one or more embodiments of the invention.

Referring now to FIG. 10, a computer program product 1000 in accordance with an embodiment that includes a computer readable storage medium 1002 and program instructions 1004 is generally shown.

The invention described herein provides an improvement over traditional systems by leveraging the social network of a user to locate other unknown members in the network that are within proximity of the user requiring assistance. The invention does not blindly broadcast notifications and alerts to a static list of contacts as in conventional systems.

The techniques allow those individuals that are in close proximity to the user to intervene and offer assistance, which potentially takes less time than waiting for the proper authorities such as security or the police to respond. One or more embodiments of the invention provide details of how the set of unknown individuals are determined to provide the alerts.

As more and more users log-in to the system, the different neighborhoods can be dynamically formed in real-time in order to locate members who are in proximity to the user requiring assistance by personally responding to the user requiring assistance and/or contacting the proper authorities.

The technical contribution of the invention includes the ability to alert anonymous and total strangers that a user is in trouble and needs assistance. This allows others to intervene and provide help possibly prior to the arrival of emergency responders. As opposed to a static list of people to notify, the set of people who can see the alert is changing dynamically as users log in and out of the application, as well as their proximity.

The technological contribution includes the dynamic assignment of neighborhoods that are based on geography, population and user density. The area of the neighborhood can increase and decrease based on the information. This ensures that a threshold number of users receive notifications pertaining to the user requiring assistance and also only notify the users that are in a position to provide assistance. All of the users in the user base are not notified, only those that are in a position to help. This feature allows for unknown members to respond to the user requiring assistance prior to emergency responders to be contacted and arrive at the scene.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instruction by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments described herein.

What is claimed is:

1. A computer-implemented method comprising:

receiving an input from a user at a location, wherein the input is associated with an event requiring assistance from another user;

dynamically assigning a neighborhood based at least in part on the input, wherein the neighborhood represents a vicinity of the location;

determining at least a threshold number of users is in the neighborhood; and based on the determination, sending a real-time alert to the users in the neighborhood, wherein the real-time alert includes information pertaining to the event requiring assistance.

2. The computer-implemented method of claim 1, wherein if the threshold number of users is not reached, expanding the neighborhood to reach the threshold number of users, and wherein the dynamically assigning the neighborhood is based at least in part on a geography, user density, and classification.

3. The computer-implemented method of claim 1, further comprises:

receiving travel information;

monitoring a route of the user;

determining a deviation in the route based at least in part on the travel information; and prompting a status of the user based on the deviation.

4. The computer-implemented method of claim 1, comprising:

determining a path deviation, wherein the path deviation is based on a physical deviation from an expected route or a deviation of an expected time of arrival; and prompting the user for a user status.

5. The computer-implemented method of claim 1, comprising:

automatically expanding the neighborhood based on not detecting another user within a configurable distance or within a configurable time period of the received input.

6. The computer-implemented method of claim 1 comprising:

automatically alerting emergency officials upon determining that no users exist in the neighborhood.

7. The computer-implemented method of claim 1, wherein sending the real-time alert comprises a list including a static portion of the list and the list includes a dynamic portion of the list, wherein the static portion is configured by the user.

8. A system comprising:

a storage medium, the storage medium being coupled to a processor;

the processor configured to:

receive an input from a user at a location, wherein the input is associated with an event requiring assistance from another user;

dynamically assign a neighborhood based at least in part on the input, wherein the neighborhood represents a vicinity of the location;

determine at least a threshold number of user is in the neighborhood; and based on the determination, send a real-time alert to the users in the neighborhood, wherein the real-timer alert includes information pertaining to the event requiring assistance.

9. The system of claim 8, wherein if the threshold number of users is not reached, expanding the neighborhood to reach the threshold number of users, and wherein the dynamically assigning the neighborhood is based at least in part on the geography, user density, and classification.

10. The system of claim 8, wherein the processor is further configured to:

receive travel information;

monitor a route of the user;

determine a deviation in the route based at least in part on the travel information; and prompt a status of the user based on the deviation.

11. The system of claim 8, wherein the processor is further configured to:

determine a path deviation, wherein the path deviation is based on a physical deviation from an expected route or a deviation of an expected time of arrival; and prompt the user for a user status.

12. The system of claim 8, wherein the processor is further configured to:

automatically expand the neighborhood based on not detecting another user within a configurable distance or within a configurable time period of the received input.

13. The system of claim 8, wherein the processor is further configured to:

automatically alert emergency officials upon determining that no users exist in the neighborhood.

14. The system of claim 8, wherein sending the real-time alert comprises a list including a static portion of the list and the list includes a dynamic portion of the list, wherein the static portion is configured by the user.

15. A computer program product comprising:

a computer readable storage medium having stored thereon program instructions executable by a processor to cause the processor to:

receive an input from a user at a location, wherein the input is associated with an event requiring assistance from another user;

dynamically assign a neighborhood based at least in part on the input, wherein the neighborhood represents a vicinity of the location;

determine at least a threshold number of users is in the neighborhood; and based on the determination, send a real-time alert to the users in the neighborhood, wherein the real-time alert includes information pertaining to the event requiring assistance.

16. The computer program product of claim 15, wherein if the threshold number of users is not reached, the instructions are further executable by the processor to cause the processor to expand the neighborhood to reach the threshold number of users, and wherein dynamically assigning the neighborhood is based at least in part on the geography, user density, and classification.

17. The computer program product of claim 15, wherein the instructions are further executable by the processor to cause the processor to:

receive travel information;

monitor a route of the user;

determine a deviation in the route based at least in part on the travel information; and prompt a status of the user based on the deviation.

18. The computer program product of claim 15, wherein the instructions are further executable by the processor to cause the processor to:

determine a path deviation, wherein the path deviation is based on a physical deviation from an expected route or a deviation of an expected time of arrival; and prompt the user for a user status.

19. The computer program product of claim 15, wherein the instructions are further executable by the processor to cause the processor to automatically expand the neighborhood based on not detecting another user within a configurable distance or within a configurable time period of the received input.

20. The computer program product of claim 15, wherein sending the real-time alert comprises a list including a static portion of the list and the list includes a dynamic portion of the list, wherein the static portion is configured by the user.

* * * * *